US005476576A

United States Patent [19]

Solomon et al.

[11] Patent Number: 5,476,576

[45] Date of Patent: Dec. 19, 1995

[54] IMPRESSED CURRENT CATHODIC PROTECTION SYSTEM

[75] Inventors: Isaac Solomon, Melbourne, Australia; Bob Phang, Kuala Lumpur, Australia

[73] Assignees: Winn and Coales International Limited, London, United Kingdom; Solomon Corrosion Consulting Services Pty. Ltd., Victoria, Australia

[21] Appl. No.: 193,195

[22] PCT Filed: Aug. 13, 1992

[86] PCT No.: PCT/AU92/00424

§ 371 Date: Apr. 14, 1994

§ 102(e) Date: Apr. 14, 1994

[87] PCT Pub. No.: WO93/04217

PCT Pub. Date: Mar. 4, 1993

[30] Foreign Application Priority Data

Aug. 15, 1991 [AU] Australia ..... PK7753
Mar. 12, 1992 [NZ] New Zealand ..... 241944

[51] Int. Cl.[6] ..... C23F 13/00

[52] U.S. Cl. ..... 204/147; 204/196

[58] Field of Search ..... 204/130, 147, 204/148, 196, 197

[56] References Cited

U.S. PATENT DOCUMENTS 2,423,290 7/1947 Bonwitt ..... 204/148
4,255,241 3/1981 Kroon et al. ..... 204/196
4,578,215 3/1986 Bradley ..... 252/514
4,900,410 2/1990 Bennett ..... 204/147
5,292,411 3/1994 Bartholomew et al. ..... 204/147
5,296,120 3/1994 Bennett et al. ..... 204/130

FOREIGN PATENT DOCUMENTS 599958 2/1987 Australia .
2170512A 1/1985 United Kingdom .

*Primary Examiner*—T. Tung
*Attorney, Agent, or Firm*—Lowe, Price, LeBlanc & Becker

[57] ABSTRACT

A system for impressed current cathodic protection of a structure having a corrodible metal reinforcing member comprising: a) an electron source having a positive terminal and a negative terminal connected to said corrodible metal reinforcing member such that electrons can flow from said negative terminal to said reinforcing member; b) an anode proximate said structure connected to said positive terminal of said electron source; and c) a pliable conductive substrate substantially enveloping said anode and in intimate contact with at least a portion of said structure. The pliable conductive substrate used comprises a suspension of a conductive compound in a viscous liquid impregnated in a flexible support medium.

19 Claims, 1 Drawing Sheet

IMPRESSED CURRENT CATHODIC PROTECTION SYSTEM

The present invention relates to cathodic protection of structures, or particularly it relates to a system of impressed current cathodic protection. It will be convenient to describe the invention with reference to particular application for cathodic protection of bridge and pier columns in marine environments however it should be noted that the invention has a wider application.

In the current economic environment a greater emphasis is being given to the general upkeep, preservation and overall extension of the physical life of existing bridge and pier structures in often excess of the original design life. As a significant proportion of such structures consist of steel reinforced/pre-stressed concrete, corrosion of the steel reinforcing members within the concrete presents a significant problem, particularly in marine and tidal environments where the kinetics of corrosion are greatly increased.

There are various known methods of protecting the steel reinforcement by way of cathodic protection. One method of such protection is achieved by the use of a sacrificial anode. A metal higher in the galvanic series than the metal sought to be protected is electrically connected to the latter. The sacrificial anode, such as magnesium supplies electrons to the steel reinforcement and gradually decays in the process. The sacrificial anode must be periodically replaced to provide continuous corrosion protection.

An alternative method of supplying electrons is by way of impressed current cathodic protection. This method involves supplying electrons from an external source, the steel reinforcing member being connected to the negative side of the electromotive force and the positive side is connected to an anode.

Over the last ten to fifteen years different types of impressed current cathodic protection systems have been developed for the protection of reinforced concrete structures. These systems have included titanium mesh/cementitious overlays, conductive coatings, spray-on metallised zinc, conductive rubber anodes and internally mounted graphite/titanium anodes. Problems associated with the above systems include complexity of design, specification and on-site works required including preparation of concrete surface and subsequent maintenance. Furthermore, it is necessary to enable installation at low costs as well as to minimize the level of expertise required to install these systems.

A further problem with impressed current cathodic protection systems is current dumping. In the case of marine pier or bridge structures three distinct exposure zones consisted with corresponding corrosion zones are identified:

(a) atmospheric zone—subject to salt, spray, wind and weathering by the sun;

(b) tidal/splash zone—subject to tidal water rich in chloride and greatly influenced by the wetting and drying process which promotes ingress of water and difusion of oxygen and chloride ions; and (c) submerged zone—where piles and pile caps are under water or completely saturated thus severely restricting the supply of oxygen which is vital for corrosion initiation and subsequent propagation. Some of the above impressed current cathodic protection systems require periodical wetting of an anode substrate in the tidal/splash zone to maintain conductivity for the protective current. In column tidal zones dumping of current to surrounding steel reinforcement occurs when the tide rises and conductivity is restored through the conductance of salt water which generally has a resistivity of between 25 and 1600 ohm.cm.

There is a need to provide a system for impressed current cathodic protection for reinforced concrete piling which reduces current dumping, is relatively easy to install and does not require exceptionally skilled labour for its installation and which is relatively inexpensive to maintain. Moreover there is a need for an impressed current cathodic protection system which provides an adjustable current density control to achieve an even polarization of the steel reinforcement. There is also a need for a protection system which does not significantly affect the volume occupied by the structure or add significantly to the mass of the structure to be protected.

It is an object of the present invention to provide a solution to one or more of the above needs.

In one aspect of the present invention there is provided a system for impressed current cathodic protection of a structure having a corrodible metal reinforcing member comprising:

(a) an electron source having a positive terminal and a negative terminal connected to said corrodible metal reinforcing member such that electrons can flow from said negative terminal to said reinforcing member;

(b) an anode proximate said structure connected to said positive terminal of said electron source; and (c) a pliable conductive substrate substantially enveloping said anode and in intimate contact with at least a portion of said structure.

In another aspect of the present invention there is provided a method of preventing corrosion in a structure having a corrodible metal reinforcing member comprising:

(a) providing an electron source having a positive terminal and a negative terminal connected to said corrodible metal reinforcing member;

(b) providing an anode proximate said structure connected to said positive terminal of said electron source; and (c) embedding said anode in a pliable conductive substrate in intimate contact with at least a portion of said structure.

In another aspect of the invention there is provided a pliable conductive substrate for use in an impressed current cathodic protection system comprising a suspension of a conductive compound in a viscous liquid impregnated in a flexible support medium.

In most cases, the corrodible metal reinforcing member is a steel reinforcing rod or rods, usually cast within the structure such as a concrete pier or bridge column or the like. The present invention may be equally useful where other reinforcing members of metals other than steel which are subject to corrosion are used.

The electron source may be any suitable means of providing electromotive force. The electron source may be a battery or a transformer/rectifier. Preferably the electron source is a transformer/rectifier which supplies continuous direct current to the system. The electron source may be positioned distant from the structure as is convenient and electrically connected to the metal reinforcing member and anode via feeder cables. The electron source is preferably capable of providing adjustable current and voltage to provide varying current and voltage depending on the system's power needs. The electron source may optionally be provided with lightning surge protection, filtering and low ripple.

The anode may be any suitable electroconductive means known in the art. The anode may be a mixed metal oxide coated titanium mesh or wire known in the art and sold under the trade names LIDA or ELGARD. The anode must be proximate the structure in need of cathodic protection in order that the impressed current provides the necessary protection. The proximity of the anode to the structure will be well known to those skilled in the art.

In one embodiment of the present invention the anode at least partially surrounds the structure, preferably surrounding the structure in the region where corrosion of the reinforcing member is most pronounced. In another aspect of the present invention the anode may be provided in one or more recesses in the outside face or faces of the structure.

The pliable conductive substrate substantially envelopes the anode and is in intimate contact with at least a portion of the structure. In one embodiment of the invention the pliable conductive substrate is in the form of a pliable conductive paste. The substrate preferably has a putty-like consistency in order that it can be formed into a desired shape on the structure and will retain that shape once it has been so formed. Preferably, the substrate has sufficient plasticity to be workable into irregularities in the surface of the structure, yet will not slump when applied to a vertical surface.

In another aspect of the invention, the pliable conductive substrate may consist of a flexible support medium impregnated with a pliable conductive medium. The flexible support medium may be a woven or non-woven layer preferably being porous in order to be impregnatable with the pliable conductive medium. Preferably, the flexible support medium is in the form of a tape formed from polypropylene or the like. In this form of the invention, the anode may be enveloped in the pliable conductive substrate by sandwiching the anode between two layers of flexible medium impregnated with the pliable conductive medium.

The pliable conductive medium impregnated within the flexible support medium may be of the same composition as the pliable conductive substrate described in the alternative form of the invention. The conductive medium may be an admixture or suspension of a conductive compound in a viscous liquid. Preferably the conductive compound is graphite in the form of flakes and/or prowder. Alternatively the conductive compound may be metal filings.

The viscous liquid is preferably in the form of a grease or wax such as petrolatum, although other grease or putty-like viscous liquids may be used. When the viscous liquid is a petroleum grease such as petrolatum the conductive substrate has the added advantage of inhibiting oxygen contact with the structure, this reducing corrosion by providing to some extent a physical barrier to oxygen and water. When the system is used in marine environments it is essential that the viscous liquid is not soluble in sea water and is capable of withstanding a small degree of mechanical abuse by way of wave action.

The resistivity of the conductive substrate is generally less than 500 ohm.cm. Preferably, between 50 to 200 ohm.cm.

It is generally desirable to apply the protection system to those parts of the structure where corrosion of the reinforcing member is most significant, particularly the tidal/splash zones. The extent to which recesses are to be formed in the structure will depend upon for example the number and positioning of reinforcing members in the structure, the extent to which the structure can be changed by providing recesses without significantly affecting the strength of the structure, the extent of cathodic protection necessary. If it is important that the structure not be altered, then the preferred method of cathodic protection is by applying the conductive tape system. If it is important that the volume occupied by the structure be unchanged then the recess system is preferred.

The current requirements to effect cathodic protection vary depending on a number of factors known to those skilled in the art. A permanent reference electrode is optionally embedded within the structure for this purpose.

The protection criteria used for the evaluation of successful cathodic protection is in accordance with the NACE Task Group T-3K-2 for mesh anodes.

Corrosion protection, or polarisation of the steel reinforcement is achieved when it has polarised by a minimum of 100 mV at anodic locations. The polarisation decay method is determined by interrupting the cathodic protection current and monitoring the reinforcement potential relative to the permanently embedded reference electrode. When the current is interrupted, an immediate voltage shift occurs. This voltage shift is free of IR drop. The criteria is achieved when at least 100 mV potential decay occurs over a period of four to twenty four hours.

Instantaneous "off" potentials are measured immediately after the cathodic protection current is switched off, typically, within one second of circuit interruption.

This criterion suggests that the reinforcing steel shall be a minimum of 100 mV more negative (shift in potential) at anodic locations. The potential shift (polarisation) is defined as the instantaneous "off" potential after interrupting the current minus the reinforcement natural potential. Based on this value protection is being achieved.

The evaluation of cathodic protection system performance is based on the 100 mV polarisation decay criterion for routine assessment. This has been widely adopted worldwide as the interpretation of results is simple and there is experimental evidence to indicate that a system is operating.

The use of the potential shift cirterion is applicable during commissioning when the potentials are shifted from "as found" natural state. However, this technique is not readily applied in the routine assessment of cathodic protection performance as electrochemical changes within the concrete and reinforcement alters the natural state potentials.

It will now be convenient to describe the invention with reference to a preferred embodiment illustrated in the accompanying drawings. It is to be understood that the drawings and following description relate to a preferred embodiment only and are not intended to limit the scope of the invention.

Figure 1:
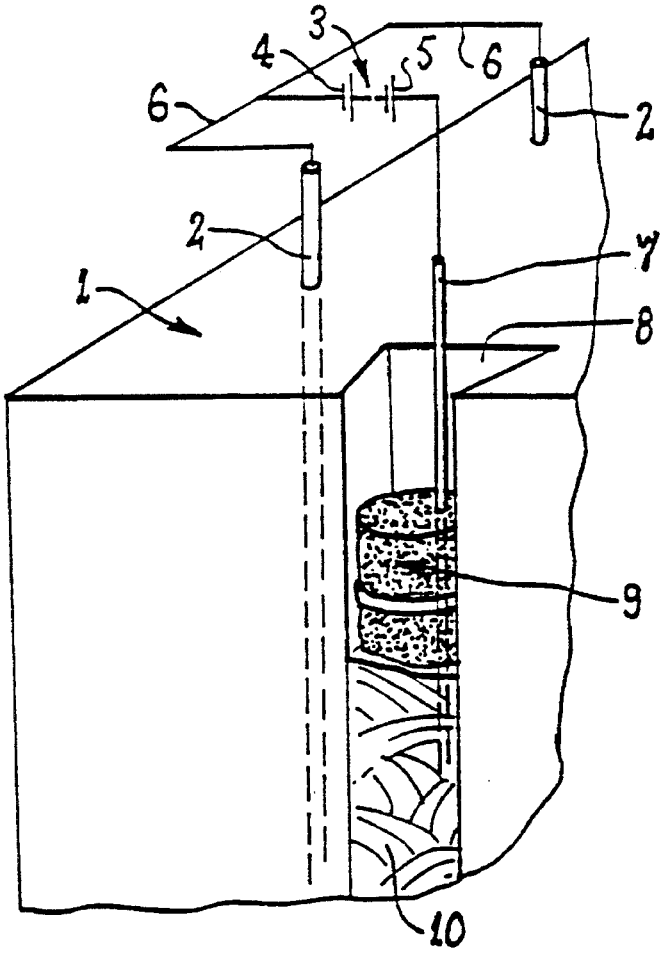
FIG. 1 shows a perspective view of a structure incorporating an impressed current cathodic protection system of the present invention with a portion of the structure cut away.
Figure 2:
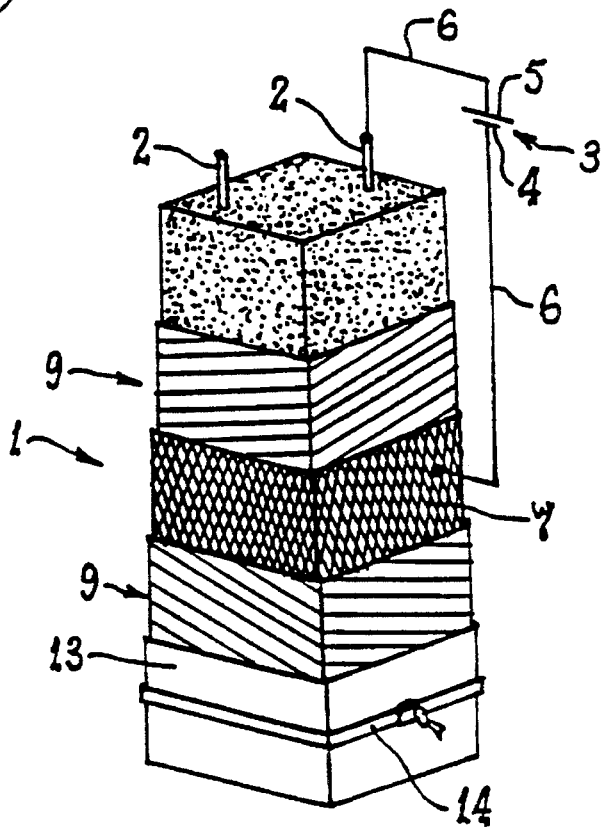
FIG. 2 is a perspective view of a structure incorporating an impressed current cathodic protection system in another form of the present invention with successive layers cut away to reveal underneath layers.

Structure 1 incorporates a reinforcing member 2. In most circumstances, structure 1 is a pre-stressed/reinforced concrete column including a steel reinforcing rod cast therein. More than one reinforcing member 2 may have been preformed in the structure and it is generally desirable to incorporate all such reinforcing members within the system.

Electron source 3 is a transformer/rectifier or the like having a positive terminal 4 and a negative terminal 5. The negative terminal 5 is electrically connected to reinforcing member 2 by cable 6 such that electrons can flow from the electron source 3 to the reinforcing member 2. Anode 7 is located in a recess 8 provided in structure 1. Recess 8 may be formed in structure 1 by being cut out of structure 1 by any suitable means such as grinding, sawing, drilling or the like. Anode 7 may be a mixed metal oxide coated titanium wire known in the art such as that sold under the trade name LIDA. Anode 7 is packed into recess 8 with pliable conductive substrate 9. Substrate 9 consists of a suspension of an admixture of petrolatum and graphite in the form of powder and flakes. A dry pack cementitious mortar 10 may be grouted over recess 8 to give the surface of structure 1 a flush finish. A plurality of recesses (not shown) may be configured in structure 1 as described above to ensure even current distribution between anode 7 and reinforcing member 2.

In another aspect of the invention structure 1 having a corrodible metal reinforcing member 2 is similarly connected to electron source 3 by way of a cables 6 attached between the negative terminal 5 and the reinforcing member 2, and the positive terminal 4 and anode 7. In this embodiment, pliable conductive substrate 9 consists of a flexible tape impregnated with a pliable conductive medium. The pliable conductive medium may be of the same composition as pliable conductive substrate shown in FIG. 1 namely an admixture of petrolatum and graphite. In this embodiment the flexible tape is wrapped around structure 1 in the region where it is desirable to protect the reinforcing member 2 by way of impressed current cathodic protection. Anode 7 is a mixed metal oxide coated titanium mesh as is known in the art and is sold under the trade name LIDA. Anode 7 is wrapped around structure 1 over the flexible tape. A further layer of pliable conductive substrate is applied over mesh anode 7 to secure and provide a contact surface for the outer face of mesh anode 7. A mechanical support layer 13 may further be provided as a further over-wrap of the outer conductive substrate layer. The mechanical support may be a polyethylene sheet or the like wrapped around the column. The polyethylene sheet may be secured by a strap 14 or similar securing means.

Finally it will be appreciated that various modifications, additions and/or alterations may be made to the system and method previously described without departing from the ambit of the present invention.

We claim:

1. A system for impressed current cathodic protection of a structure having a corrodible metal reinforcing member comprising:

(a) an electron source having a positive terminal and a negative terminal connected to said corrodible metal reinforcing member such that electrons can flow from said negative terminal to said reinforcing member;

(b) an anode proximate said structure and connected to said positive terminal of said electron source; and (c) a pliable conductive substrate substantially enveloping said anode and in intimate contact with at least a portion of said structure wherein said pliable conductive substrate comprises a pliable conductive medium comprising a conductive material in a viscous liquid and wherein said viscous liquid is a grease.

2. A system according to claim 1, wherein said pliable conductive substrate comprises a flexible support medium impregnated with said pliable conductive medium.

3. A system according to claim 2, wherein said flexible support medium is in the form of a tape.

4. A system according to claim 2, wherein said anode is in the form of a mesh juxtaposed between two layers of said pliable conductive substrate.

5. A system according to claim 2, wherein said anode substantially surrounds at least a portion of said structure.

6. A system according to claim 1, wherein said pliable conductive substrate is in the form of a putty.

7. A system according to claim 6, wherein said anode is in the form of a wire embedded in said substrate.

8. A system according to claim 6, wherein said anode is in positioned in a recess provided in said structure.

9. A system according to claim 1, wherein said conductive material is graphite in the form of powder and/or flakes.

10. A system according to claim 1, wherein said pliable conductive substrate has a resistivity of less than 500 ohm.cm.

11. A system according to claim 1, wherein said pliable conductive substrate has a resistivity of between 50 and 200 ohm.cm.

12. A method of providing impressed current cathodic protecting to a structure having a corrodible metal reinforcing member comprising the steps of:

(a) connecting said corrodible metal reinforcing member to a negative side of an electron source;

(b) forming a recess in said structure;

(c) positioning an anode in said recess, said anode being surrounded by a pliable conductive substrate in intimate contact with said structure wherein said conductive substrate comprises a pliable conductive medium comprising a conductive material in a viscous liquid and wherein said viscous liquid is a grease; and (d) connecting said anode to a positive side of said electron source.

13. A method according to claim 12, wherein said recess is filled substantially flush to a surface of the structure after said anode and pliable conductive substrate have been positioned therein.

14. A method of providing impressed current cathodic protecting to a structure having a corrodible metal reinforcing member comprising the steps of:

(a) connecting said corrodible metal reinforcing member to a negative terminal of an electron source;

(b) applying a flexible support medium impregnated with a pliable conductive medium to at least a portion of said structure wherein said conductive medium comprises a conductive material in a viscous liquid and wherein said viscous liquid is a grease;

(c) at least partially embedding an anode in said pliable conductive medium; and (d) connecting said anode to a positive terminal of said electron source.

15. A method according to claim 14, wherein said anode is substantially covered by a further layer of a flexible support medium impregnated with a pliable conductive medium.

16. A method according to claim 14, wherein said flexible support medium and pliable conductive medium are overwrapped by a mechanical protection means.

17. A pliable conductive substrate for used in an impressed current cathodic protection system which comprises a flexible support medium impregnated with a suspension of a conductive material in a viscous liquid and wherein said viscous liquid is a grease.

18. A pliable conductive substrate according to claim 17, wherein said flexible support medium is a woven or non-woven porous tape.

19. A pliable conductive substrate according to claim 17, wherein said conducive material is graphite.

* * * * *